US009300057B2

(12) United States Patent
Kan et al.

(10) Patent No.: US 9,300,057 B2
(45) Date of Patent: Mar. 29, 2016

(54) MULTI-POLE WIRE CONNECTOR SOCKET

(71) Applicant: KINSUN INDUSTRIES INC., Pingjhen (TW)

(72) Inventors: Ching-Neng Kan, Taoyuan County (TW); Chang-Chun Huang, Taoyuan County (TW)

(73) Assignee: KINSUN INDUSTRIES INC., Pingjhen (TW)

( * ) Notice: Subject to any disclaimer, the term of this patent is extended or adjusted under 35 U.S.C. 154(b) by 37 days.

(21) Appl. No.: 14/180,590

(22) Filed: Feb. 14, 2014

(65) Prior Publication Data

US 2014/0248790 A1 Sep. 4, 2014

(30) Foreign Application Priority Data

Mar. 1, 2013 (TW) ..... 102203850 U

(51) Int. Cl.
*H01R 4/24* (2006.01)
*H01R 24/64* (2011.01)

(52) U.S. Cl.
CPC ..... *H01R 4/24* (2013.01); *H01R 4/2433* (2013.01); *H01R 24/64* (2013.01)

(58) Field of Classification Search
CPC ..... H01R 4/2433
USPC ..... 439/409, 410
See application file for complete search history.

(56) References Cited

U.S. PATENT DOCUMENTS

| | | | | | |
|---|---|---|---|---|---|
| 4,995,829 | A * | 2/1991 | Geib | H01R 4/2433 | 439/409 |
| 6,022,240 | A * | 2/2000 | McCleerey | H01R 4/2408 | 439/410 |
| 6,036,532 | A * | 3/2000 | Feistkorn | H01R 4/5008 | 439/393 |
| 6,048,223 | A * | 4/2000 | Bechaz | H01R 4/2433 | 439/409 |
| 6,848,945 | B1 * | 2/2005 | Lecuppe | H05K 7/02 | 439/409 |
| 7,833,047 | B2 * | 11/2010 | Pizzi | H01R 4/4827 | 439/395 |

* cited by examiner

*Primary Examiner* — Phuong Dinh
(74) *Attorney, Agent, or Firm* — WPAT, P.C.; Justin King

(57) ABSTRACT

A multi-pole wire connection socket comprises: a frame, configured with a plurality of conductive elements and a plurality of inset holes; a plurality of guillotine elements, having a plurality of protrusions at positions for allowing the protrusions to inset into the inset holes for enabling the guillotine elements to pivot relative to the frame; wherein the plural conductive elements have a plurality of conductive rings; and there is a plurality of via holes formed on the plural guillotine elements, which are provided for a plurality of wires to thread through. Operationally, the insulation around wires, threading through the via holes and the conductive rings, will be cut open for exposing the wires to couple electrically with the conductive elements as soon as wires are bended by the plural guillotine elements Thereby, the wires are electrically connected without having to use any tool for peeling off the insulations of the wires.

6 Claims, 6 Drawing Sheets

MULTI-POLE WIRE CONNECTOR SOCKET

FIELD OF THE INVENTION

The present invention relates to a multi-pole wire connector socket, and more particularly, to a connector structure capable of enabling a wire connection operation to be performed rapidly and efficiently without using any tool.

BACKGROUND OF THE INVENTION

With rapid advance of technology, there are all kinds of 3C products becoming available that not only would facilitate our lives, but also shorten the distance between people. However, as the transmission speed of information is also increasing with the advance of technology, there are a variety of network connectors and connection cables on the market for connecting 3C products and data transmission. Among which, 3C products relating to network connectors for network connection and data transmission are common in a variety of applications, such as network interface card (NIC), Hub, broadband router, etc., whichever are embedded with network connectors or signal connectors for signal bridging.

Generally, in order to successfully install a common communication device, especially in electrical wiring, it is necessary to have and use a number of different tools, which can include electric solder iron, tin solder, and peel wire cutter, etc. Therefore, such installation operation may be very time consuming and the quality of the operation can heavy depend upon personal skill. Thus, it is in need of a connector structure that can enable a wire connection operation to be performed rapidly and efficiently without using any tool.

SUMMARY OF THE INVENTION

In view of the disadvantages of prior art, the primary object of the present invention is to provide a connection structure capable of enabling a wire connection operation in a wire connector socket to be performed rapidly and efficiently without using any tool, but with improved stability of electrical connection.

To achieve the above object, the present invention provides a multi-pole wire connection socket, which comprises:

- a frame, configured with a plurality of conductive elements and a plurality of inset holes;
- a plurality of guillotine elements, having a plurality of protrusions formed thereon at positions for allowing the plural protrusions to inset into the plural inset holes and thus enabling the plural guillotine elements to pivot relative to the frame;
- wherein the plural conductive elements have a plurality of conductive rings formed thereat; and also there is a plurality of via holes formed on the plural guillotine elements, which are provided for a plurality of wires to thread through.

Operationally, when there are wires piercing through the plural via holes and the corresponding conductive rings of the plural conductive elements, the insulation around the wires will be cut open for exposing the wires to couple electrically with the conductive elements as soon as wires are bended by the plural guillotine elements that are pivoted to the bottom of the frame. Thereby, the wires are electrically connected without having to use any tool for peeling off the insulations of the wires.

Preferably, the multi-pole wire connection socket is adapted for communication apparatuses.

Preferably, each of the plural via hole is formed with a flange.

Preferably, the plural guillotine elements are arranged in a two-column formation.

Preferably, there are two or four said guillotine elements in the multi-pole wire connection socket.

Preferably, there are two or four said via holes in each of the plural guillotine elements.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein.

DESCRIPTION OF THE EXEMPLARY EMBODIMENTS

For your esteemed members of reviewing committee to further understand and recognize the fulfilled functions and structural characteristics of the invention, several exemplary embodiments cooperating with detailed description are presented as the follows.

Figure 1:
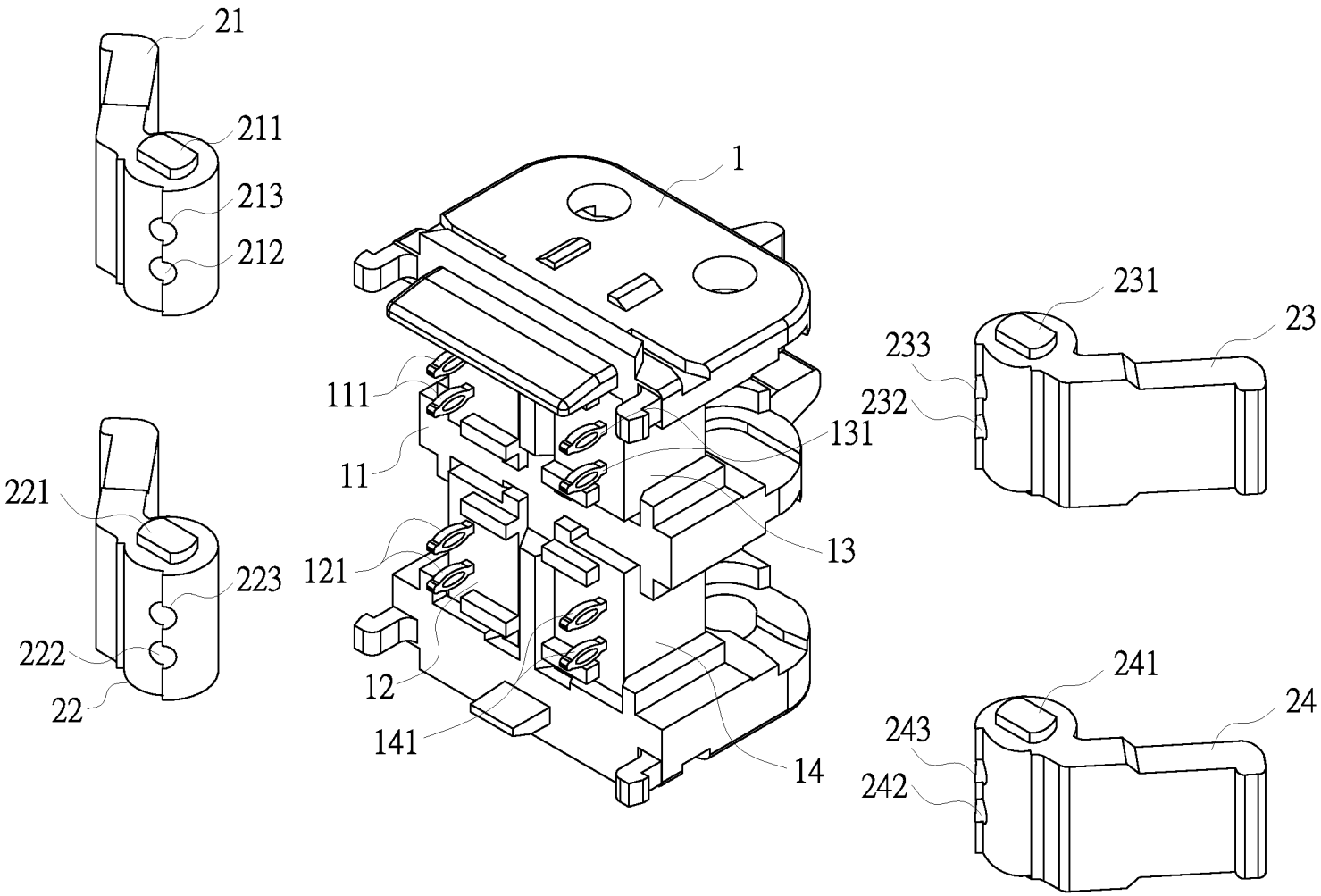
FIG. 1 is an exploded diagram showing a multi-pole wire connection socket of the present invention.
Figure 2:
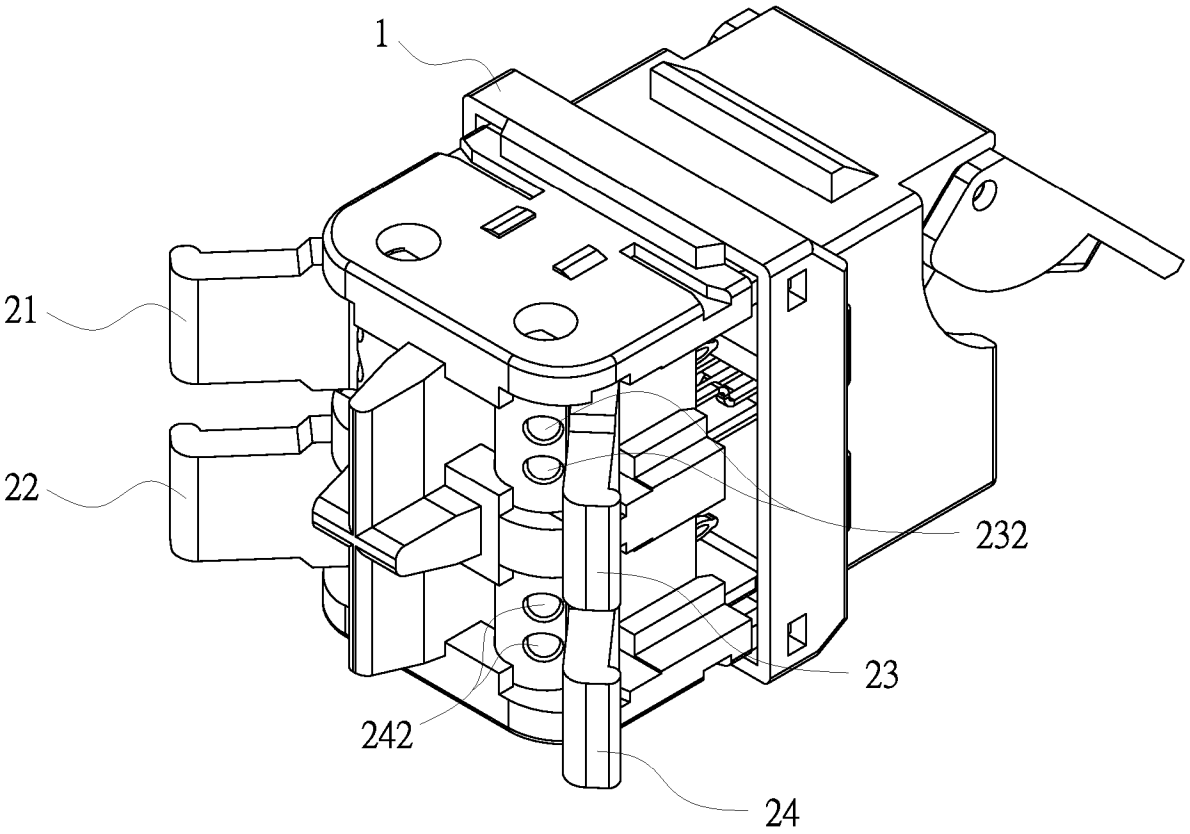
FIG. 2 is a three-dimensional diagram showing the multi-pole wire connection socket of FIG. 1.

Please refer to FIG. 1 and FIG. 2, which show a multi-pole wire connection socket of the present invention. As shown in FIG. 1 and FIG. 2, a multi-pole wire connection socket, that is designed and adapted for a communication apparatus, comprises: a frame 1, configured with a plurality of conductive elements 11, 12, 13, 14 and a plurality of inset holes; a plurality of guillotine elements 21, 22, 23, 24, being symmetrically disposed at two sides of the frame 1 in a two-column formation and having a plurality of protrusions 211, 221, 231, 241 formed thereon at positions for allowing the plural protrusions to inset into the plural inset holes and thus enabling the plural guillotine elements 21, 22, 23, 24 to pivot relative to the frame 1. In addition, the plural conductive elements 11, 12, 13, 14 have a plurality of conductive rings 111, 121, 131, 141 formed thereat; and also there is a plurality of via holes 212, 222, 232, 242 formed on the plural guillotine elements 21, 22, 23, 24. In this embodiment shown in FIG. 1 and FIG. 2, the frame 1 is configured with four conductive elements, which are a first, a second, a third and a fourth conductive elements 11, 12, 13, 14, whereas the first conductive element 11 is formed with a first conductive ring 111, the second conductive element 12 is formed with a second conductive ring 121, the third conductive element 13 is formed with a third conductive ring 131, and the fourth conductive element 14 is formed with a fourth conductive ring 141; and also there are four guillotine elements disposed in the multi-pole wire connection socket, which are a first, a second, a third and a fourth guillotine elements 21, 22, 23, 24, whereas there are protrusions 211, 221, 231, 241 formed respectively on the first, the second, the third and the fourth guillotine elements 21, 22, 23, 24 at positions for allowing the plural protrusions 211, 221, 231, 241 to inset into the plural inset holes and thus enabling the plural guillotine elements 21, 22, 23, 24 to pivot relative to the frame 1. Moreover, each of the via holes 212, 222, 232, 242 is formed with a flange 213, 223, 233, 243. In this embodiment, there are two via holes 212 in the first guillotine element 21, which is the same to the other guillotine elements 22, 23, 24, and thereby, there are overall eight via holes formed on four guillotine elements, so that the multi-pole wire connection socket can be provided to coupled with eight wires simultaneously.

Figure 3:
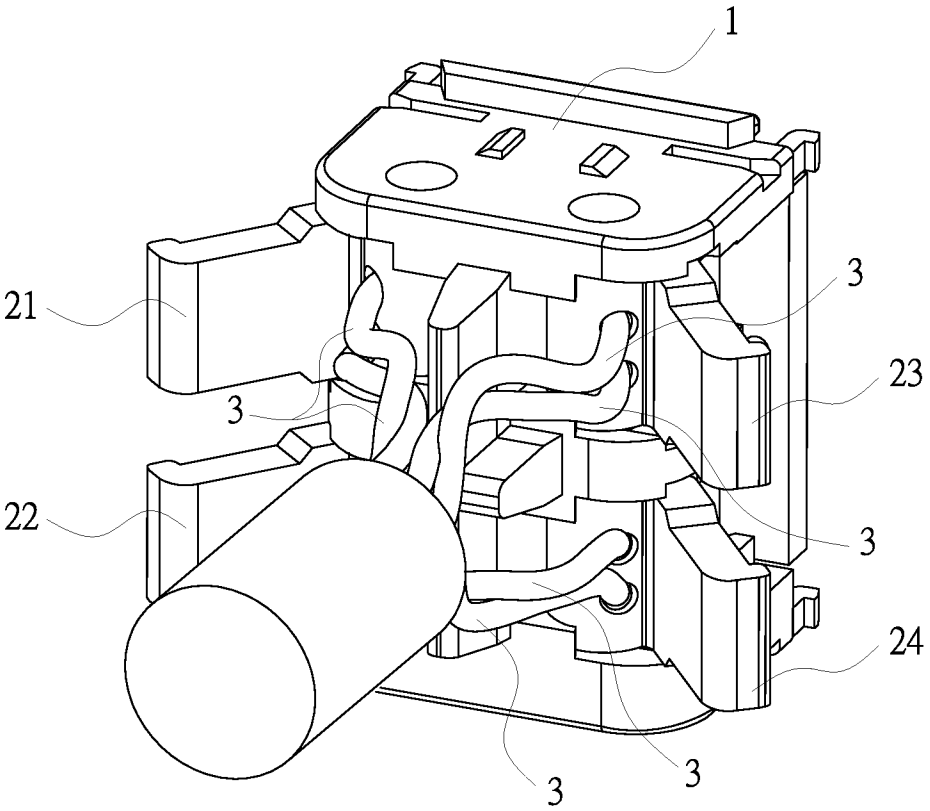
FIG. 3 is a schematic diagram showing the connection of a multi-pole wire connection socket to a plurality of wires according to a first embodiment of the invention.
Figure 4:
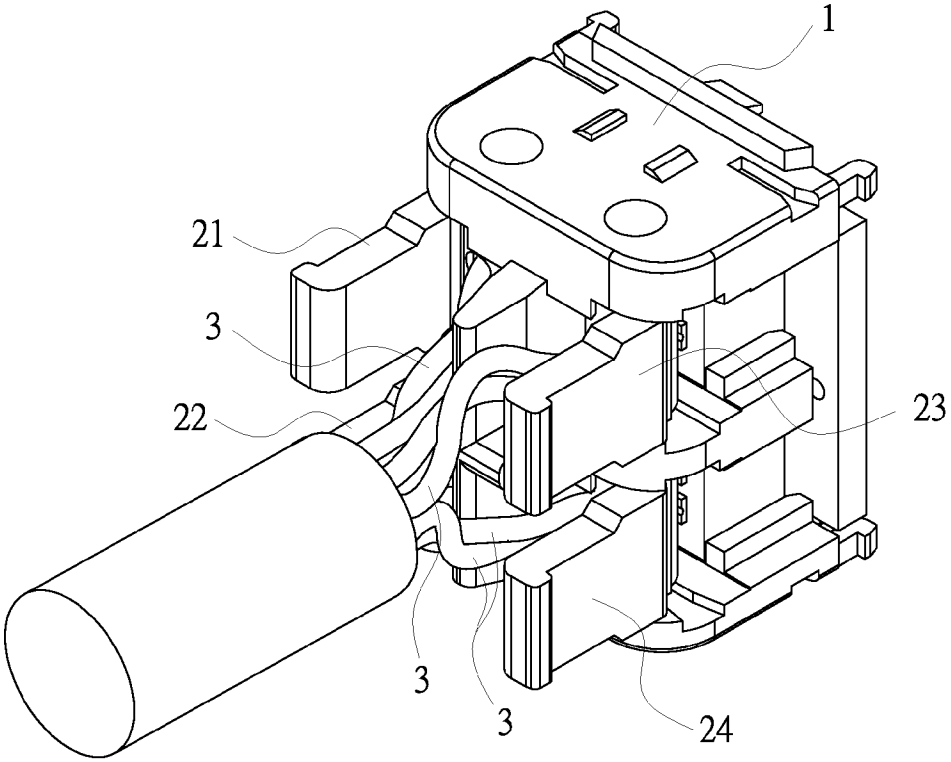
FIG. 4 is a schematic diagram showing the connection of a multi-pole wire connection socket to a plurality of wires according to a second embodiment of the invention.

Please refer to FIG. 3 and FIG. 4, which are schematic diagrams showing the connection of a multi-pole wire connection socket to a plurality of wires according to a first and a second embodiments of the invention. In FIG. 3 and FIG. 4, when there are wires 3 piercing through the plural via holes 212, 222, 232, 242 of the guillotine elements 21, 22, 23, 24 and the corresponding plural conductive rings 111, 121, 1311 141 of the plural conductive elements 11, 12, 13, 14, the insulation around the wires 3 will be cut open for exposing the wires 3 to couple electrically with the conductive elements 11, 12, 13, 14 as soon as wires 3 are bended by the plural guillotine elements 21, 22, 23, 24 that are pivoted to the bottom of the frame 1; thereby, the wires 3 are electrically connected without having to use any tool for peeling off the insulations of the wires 3.

Figure 5:
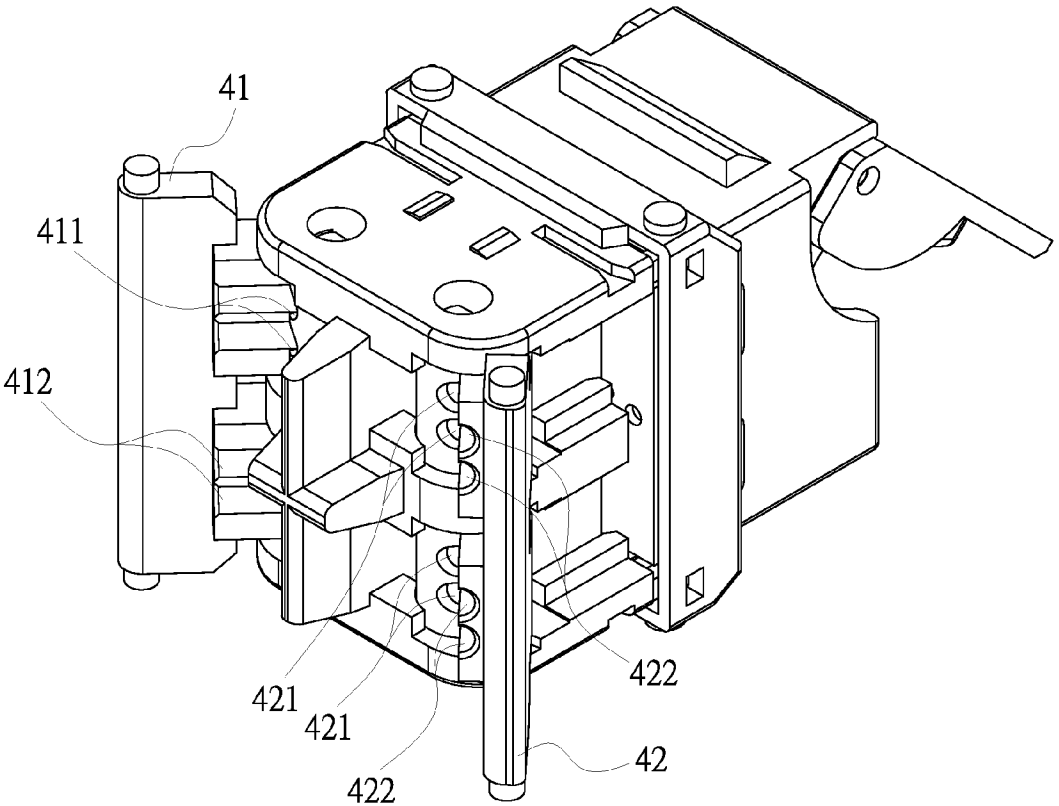
FIG. 5 is a schematic diagram showing a multi-pole wire connection socket according to an embodiment of the invention.

Please refer to FIG. 5, which is a schematic diagram showing a multi-pole wire connection socket according to an embodiment of the invention. The multi-pole wire connection socket of FIG. 5 is formed basically the same as the one shown in FIG. 2, but instead of the four guillotine elements 21, 22, 23, 24 disposed symmetrically at two sides of the frame 1 in a two-column formation, there are two slightly larger guillotine elements, i.e. a first guillotine element 41 and a second guillotine element 42, disposed respectively at two sides of the frame. In addition, there are four via holes 411 formed on the first guillotine element 41 and also there are four via holes 421 formed on the second guillotine element 42. Thereby, similarly there are overall eight via holes formed on the two guillotine elements 41, 42, so that the multi-pole wire connection socket can be provided to coupled with eight wires simultaneously. Moreover, by the bending slots 412, 422 formed respectively on the first and the second guillotine elements 41, 42, the wires can be cut open for exposing the same to be connected electrically, as those shown in FIG. 2.

Figure 6:
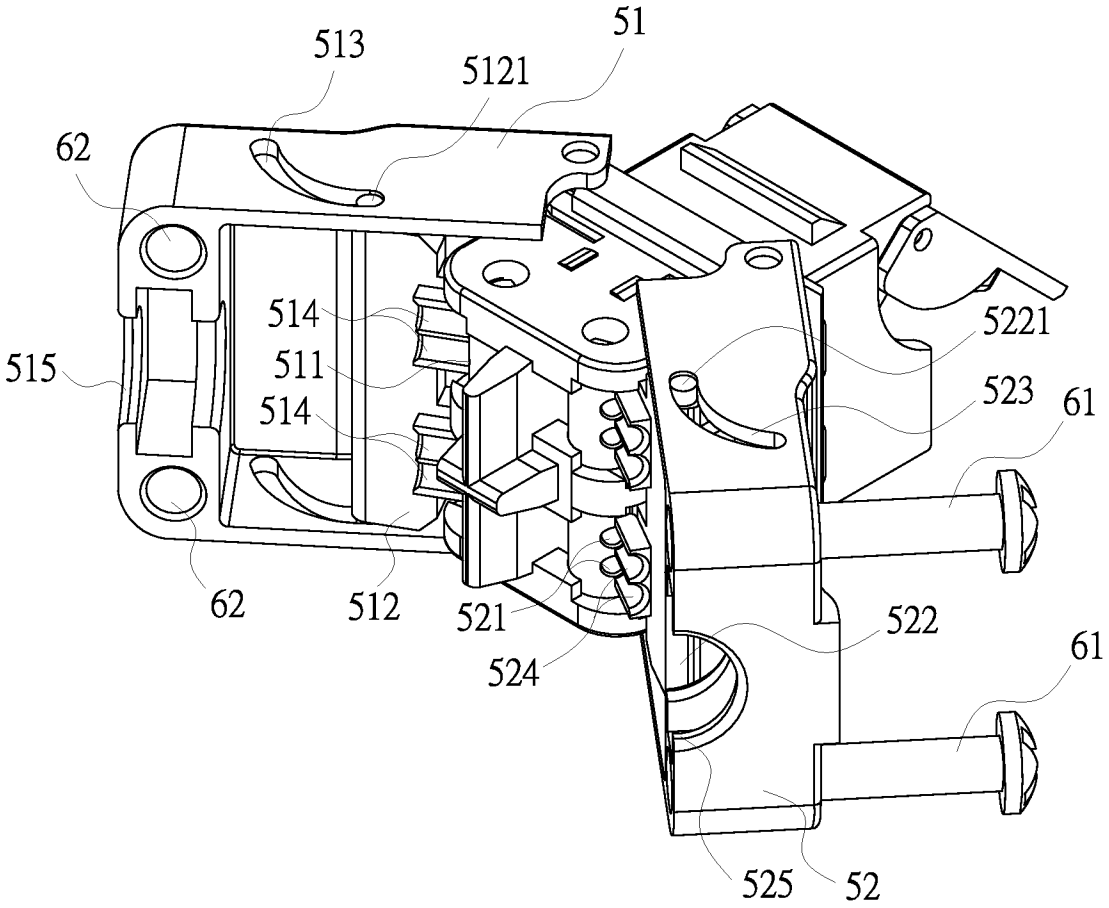
FIG. 6 is a schematic diagram showing a multi-pole wire connection socket according to another embodiment of the invention.

Please refer to FIG. 6, which is a schematic diagram showing a multi-pole wire connection socket according to another embodiment of the invention. The multi-pole wire connection socket of FIG. 6 is formed basically the same as the one shown in FIG. 2, but instead of the four guillotine elements 21, 22, 23, 24 disposed symmetrically at two sides of the frame 1 in a two-column formation, there are two slightly larger guillotine elements, i.e. a first guillotine element 51 and a second guillotine element 52, disposed respectively at two sides of the frame. In addition, there are four via holes 511 formed on the first guillotine element 51 and also there are four via holes 521 formed on the second guillotine element 52. Thereby, similarly there are overall eight via holes formed on the two guillotine elements 51, 52, so that the multi-pole wire connection socket can be provided to coupled with eight wires simultaneously, while allowing the eight wires to be received respectively inside eight stopper grooves 515, 525. In this embodiment, each of the first and the second guillotine elements 51, 52 is a half-cap structure, by that when the first and the second guillotine elements 51, 52 are rotated toward the corresponding wires, each of the first and the second guillotine elements 51, 52 is closed, forming a cap. In addition, there are two locking holes 62 formed on the first guillotine element 51 and also there are two locking holes formed on the second guillotine element 52, by that when the first and the second guillotine elements 51, 52 are rotated to a closed position, the positioning of the first and the second guillotine elements 51, 52 can be fixed and locked by inserting two fixing elements 61 into the corresponding locking holes 62. In this embodiment of FIG. 6, each of the first guillotine element 51 and the second guillotine element 52 is formed with a rotary piece, i.e. the rotary pieces 512, 522, and each of the rotary pieces 512, 522 is configured with four bending slots 514, 524. Moreover, each of the two rotary pieces 512, 522 is configured with two bumps 5121, 5221, and e the two guillotine elements 51, 52 are formed respectively with arc holes 513, 523, by that the two bumps 5121 of the rotary piece 512 are inset respectively into the arc hole 513 of the first guillotine element 51 for allowing the same to slide therein, while simultaneously the two bumps 5221 of the rotary piece 522 are inset respectively into the arc hole 523 of the second guillotine element 52 for allowing the same to slide therein, thereby, enabling the bending slots 514, 524 to bend and cut open the corresponding wires for exposing the same to be connected electrically, as those shown in FIG. 2.

To sum up, the present invention provides a connection structure capable of enabling a wire connection operation in a wire connector socket to be performed rapidly and efficiently without using any tool, but with improved stability of electrical connection. In addition, the connection structure of the present invention can be adapted for common communication apparatuses.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed is:

1. A multi-pole wire connection socket, comprising:

a frame, configured with a plurality of conductive elements and a plurality of inset holes;

a plurality of guillotine elements, having a plurality of protrusions formed thereon at positions for allowing the plural protrusions to inset into the plural inset holes and thus enabling the plural guillotine elements to pivot relative to the frame;

wherein the plural conductive elements have a plurality of conductive rings formed thereat; and also there is a plurality of via holes formed on the plural guillotine elements, which are provided for a plurality of wires to thread through; and when there are wires piercing through the plural via holes and the plural conductive rings of the plural conductive elements, insulations around the wires will be cut open for exposing the wires to couple electrically with the conductive elements as soon as wires are bended by the plural guillotine elements that are pivoted to the bottom of the frame; thereby, the wires are electrically connected without having to use any tool for peeling off the insulations of the wires.

2. The multi-pole wire connection socket of claim 1, wherein the multi-pole wire connection socket is adapted for communication apparatuses.

3. The multi-pole wire connection socket of claim 1, wherein each of the plural via hole is formed with a flange.

4. The multi-pole wire connection socket of claim 1, wherein the plural guillotine elements are arranged in a two-column formation.

5. The multi-pole wire connection socket of claim 1, wherein a quantity of said guillotine elements is two or four.

6. The multi-pole wire connection socket of claim 1, wherein there are two or four said via holes in each of the plural guillotine elements.

* * * * *